US008472828B2

(12) United States Patent
Sato

(10) Patent No.: US 8,472,828 B2
(45) Date of Patent: Jun. 25, 2013

(54) DEVELOPER FIXING DEVICE AND IMAGE FORMING APPARATUS HAVING A PLURALITY OF HEATING UNITS

(75) Inventor: Toshiki Sato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 199 days.

(21) Appl. No.: 12/961,528

(22) Filed: Dec. 7, 2010

(65) Prior Publication Data

US 2011/0135334 A1 Jun. 9, 2011

(30) Foreign Application Priority Data

Dec. 7, 2009 (JP) ..... 2009-277333

(51) Int. Cl.
*G03G 15/20* (2006.01)

(52) U.S. Cl.
USPC ..... 399/69

(58) Field of Classification Search
USPC ..... 399/69, 328
See application file for complete search history.

(56) References Cited

U.S. PATENT DOCUMENTS

2005/0276625 A1* 12/2005 Cho ..... 399/69
2006/0051113 A1* 3/2006 Kishi et al. ..... 399/44
2009/0297198 A1* 12/2009 Nanataki et al. ..... 399/69

FOREIGN PATENT DOCUMENTS

JP 08-286552 A 11/1996

* cited by examiner

*Primary Examiner* — Quana M Grainger
(74) *Attorney, Agent, or Firm* — Panitch Schwarze Belisario & Nadel LLP

(57) ABSTRACT

An invented fixing device having a fixing roller for fixing developer to a recording medium and plural fixing heaters for heating the fixing roller includes a temperature detection unit as well as a thermistor for detecting the temperature of the fixing roller, a RAM storing the switching temperature for switching drive of the fixing heaters, a heater selection unit for selecting some of the fixing heaters to be driven based on the switching temperature and the detected temperature of the fixing member detected through the temperature detection unit, and a heat control unit for selectively driving the fixing heater selected by the heater selection unit.

17 Claims, 10 Drawing Sheets

(a)

(b)

(a)

(b)

(c)

DEVELOPER FIXING DEVICE AND IMAGE FORMING APPARATUS HAVING A PLURALITY OF HEATING UNITS

BACKGROUND OF THE INVENTION

1. Field of the Invention

This invention relates to a fixing device and an image forming apparatus.

2. Description of Related Art

Electrophotographic printers conventionally transfer toner corresponding to printing images onto a paper and fix the toner to the paper with application of heat and pressure. A prior art fixing device used in such an electrophotographic printer is arranged with plural heaters and plural temperature detecting means, which are disposed at different places in a longitudinal direction of a fixing member. The plural heaters are independently controlled based on temperature detection results given from the respective temperature detecting means, thereby rendering stable the temperature profile in the longitudinal direction of the fixing member. To reduce the maximum power consumption by selectively and exclusively driving the plural heaters, the plural heaters are controlled to be alternatively driven based on the temperature detection results given from the respective temperature detecting means to render stable the temperature profile in the longitudinal direction of the fixing member.

Japanese Unexamined Patent Publication No. H08-286552 discloses a fixing device formed with two temperature detection sensors arranged on a surface of a heating roll corresponding to regions at which the heat generating amount in an axis direction of the lamps is relatively large and formed with a power control circuit variably controlling the power supply amount fed to the two lamps based on temperature detection results obtained from the two temperature detection sensors.

With the prior art device, however, there raises a problem that fixing control becomes complicated because of frequent switching operation of the heating means. It is therefore an object of the invention to provide a fixing device for making fixing operation simple in consideration of the above technical problem.

BRIEF SUMMARY OF THE INVENTION

In accordance with a preferred embodiment of the invention to accomplish the foregoing objects, a fixing device having a fixing member for fixing a developer to a recording medium and a plurality of heating units for heating the fixing member, includes a temperature detecting unit for detecting temperature of the fixing member, a first memorizing unit for memorizing a switching temperature for switching drive of the heating units, a selecting unit for selecting the heating unit to be driven among the plural heating units based on the switching temperature and the temperature of the fixing member detected through the temperature detecting unit, and a heating control unit for selectively driving the heating unit selected by the selecting unit.

According to the preferred fixing device, the device can render fixing operation further simplified.

BRIEF DESCRIPTION OF THE DRAWINGS

This invention may take physical form in certain parts and arrangements of parts, a preferred embodiment and method of which will be described in detail in this specification and illustrated in the accompanying drawings which form a part hereof, and wherein:

FIG. 12(*b*) is a diagram showing a heat generation profile of the fixing roller along the longitudinal direction.

DETAILED DESCRIPTION OF PREFERRED EMBODIMENTS

Hereinafter, preferred embodiments according to a fixing device and an image forming apparatus of the invention are described with reference to drawings. It is to be noted that the fixing device and the image forming apparatus according to the invention are not limited to those described below but can be changed or modified as appropriate as far as not beyond the scope of the invention.

First Embodiment

Figure 1:
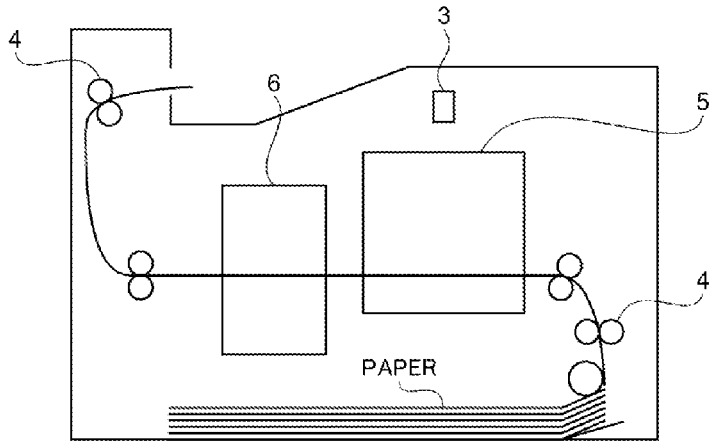
FIG. 1 is a schematic structural view showing an image forming apparatus adapting a fixing device according to a first embodiment of the invention.

FIG. 1 shows a structure of the image forming apparatus adapting the fixing device according to the first embodiment of the invention. As shown in FIG. 1, the image forming apparatus includes a paper conveyance unit 4 for conveying paper, an LED (Light Emitting Diode) head 3 serving as a recording light exposure member, a toner image formation unit 5 for forming toner images corresponding to the recording light, and a fixing device 6 for fixing the toner images on the paper. The toner image formation unit 5 and the fixing device 6 are disposed sequentially according to the order of the paper conveyance. The LED head 3 is disposed adjacently to the toner image formation unit 5.

With this structure, when a printing control unit, not shown, receives a printing command, the paper conveyance unit 4 conveys paper to the toner image formation unit 5 in synchrony with a timing of image formation. The LED head 3 emits the recording light corresponding to the printing information to the toner image formation unit 5, and the toner image formation unit 5 forms the toner images corresponding to the recording light onto the paper. Where the paper conveyance unit 4 conveys the paper to the fixing device 6, the paper conveyance unit 4 delivers the paper after the toner image is fixed onto the paper by application of heat and pressure from the fixing device 6.

Figure 2:
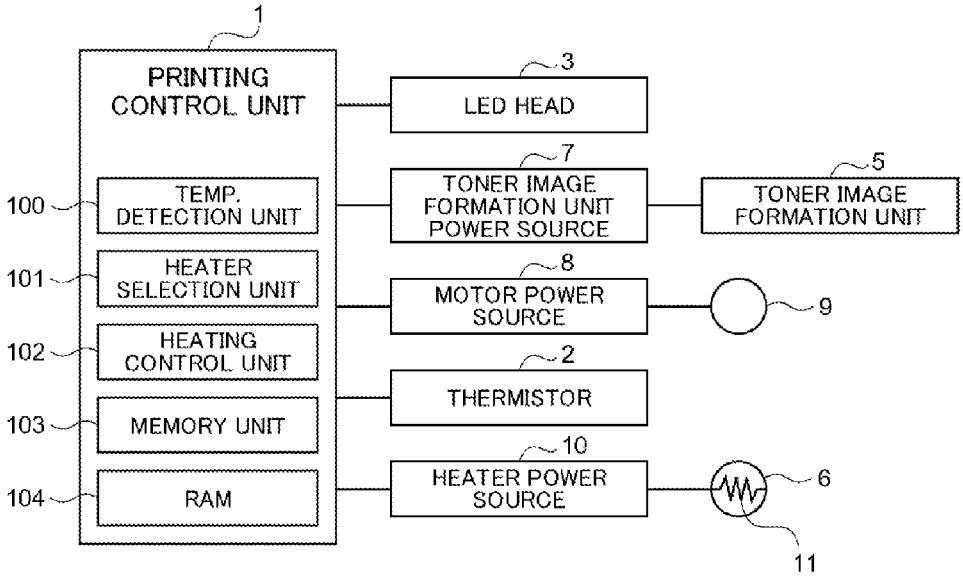
FIG. 2 is a block diagram showing a control system of the image forming apparatus adapting the fixing device according to the first embodiment of the invention.

FIG. 2, as a block diagram, shows the image forming apparatus adapting the fixing device according to the first embodiment of the invention. As shown in FIG. 2, a printing control unit 1 managing the whole control is connected to the LED head 3, a toner image formation unit power source 7, a motor power source 8, a thermistor 2, and a heater power source 10; the toner image formation unit power source 7 is connected to the toner image formation unit 5; the heater power source 8 is connected to a paper conveyance motor 9; the heater power source 10 is connected to the fixing device 6 incorporating the fixing heater 11. The printing control unit 1 incorporates a temperature detection unit 100, a heater selection unit 101, a heating control unit 102, a memory unit 103, and a RAM (Random Access Memory) 104. The temperature detection unit 100 and the thermistor 2 serve as temperature detecting means.

With this structure, the printing control unit 1 controls printing operation. The LED head 3 serves as a recording light exposing member, and the toner image formation unit 5 forms toner images corresponding to the recording light emitted from the LED head 3. The toner image formation unit power source 7 applies a voltage to the toner image formation unit 5. The paper conveyance motor 9 generates drive force to carry the paper and drives upon reception of the power supply from the motor power source 8. The fixing device 6 incorporates the fixing heater 11 for heating a fixing roller, not shown, and drives upon reception of the power supply from the heater power source 10. The thermistor 2 detects the temperature of the fixing device 6.

Furthermore, in the printing control unit 1, the temperature detection unit 100 detects the temperature of the thermistor 2. The heater selection unit 101 selects a fixing heater to be driven among the plural fixing heaters based on a switching temperature Tslc and a temperature of the fixing member. That is, as described below, the heater selection unit 101 calculates temperature differences between a setting temperature Tsp and a temperature of the fixing member detected before heating, and calculates the switching temperature Tslc. The heating control unit 102 drives the heater power source 10 to control the fixing heater as to generate heat up to the setting temperature Tsp as described below based on the detection results of the temperature detection unit 100, thereby selectively driving the fixing heater 11. That is, the heating control unit 102 serving as the heating control means selectively drives the fixing heater 11 as the heating means until that the temperature of the fixing member reaches the setting temperature Tsp. The memory unit 103 serving as a second memory means memorizes data such as the setting temperature Tsp as the target of the warming up completion of the fixing device 6. The RAM 104 serving as a first memory means memorizes data such as the switching temperature Tslc for heater drive as described below.

Figure 3:
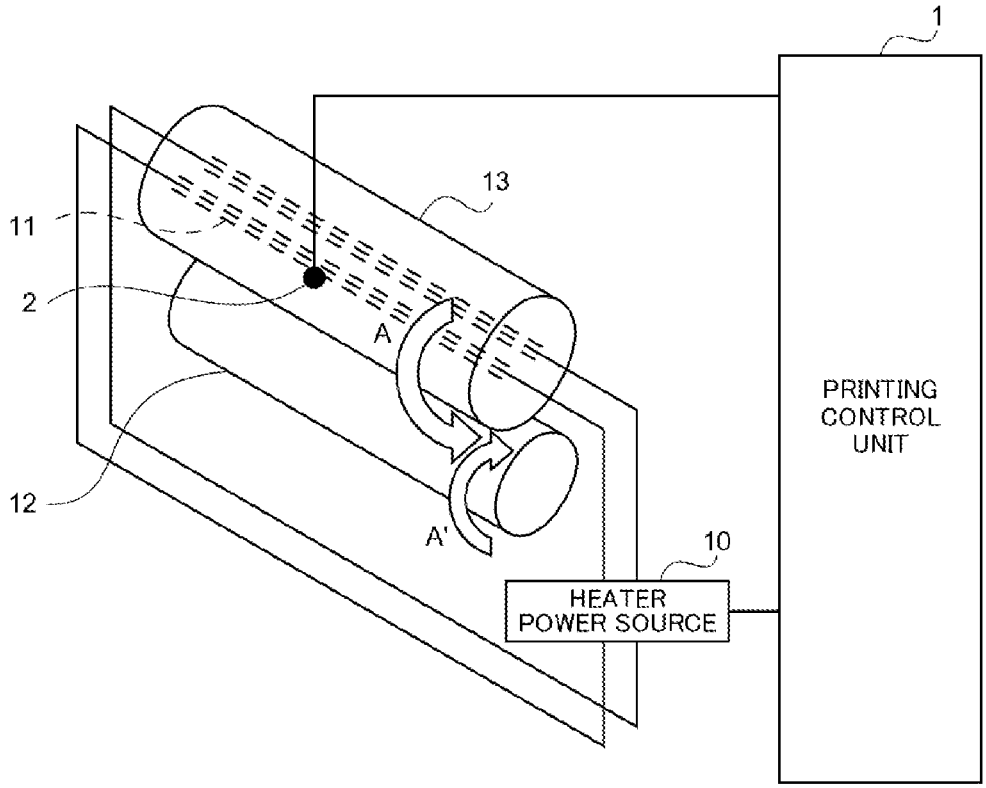
FIG. 3 is a block diagram with a perspective view showing the fixing device according to the first embodiment of the invention.

FIG. 3 is a perspective view showing a structure of the fixing device 6 in the image forming apparatus according to the first embodiment of the invention. As shown in FIG. 3, the fixing device 6 at least includes a fixing roller 13 serving as the fixing member, a pressure roller 12 in contact with the fixing roller 13, fixing heaters 11 disposed within but not in contact with the interior of the fixing roller 13 for serving as heating means, and the thermistor 2 in contact with the surface of the fixing roller 13. It is to be noted that the fixing heater 11 may be disposed in contact with the fixing roller 13 and that the surface of the thermistor 2 may be disposed not in contact with the surface of the fixing roller 13.

With such a structure, the fixing roller 13 supplies heat to the paper and feeds the paper. The fixing roller 13 is made of, e.g., a core metal as a base body formed of a steel pipe having an outer diameter of 30 millimeters, and an elastic layer covering the core metal and having a thickness of 1 millimeter made of silicone rubber. The fixing roller 13 has a gear or gears, not shown, and those gears are rotationally driven by the paper conveyance unit (corresponding to a member with reference number of "4") to rotationally drive the fixing roller 13. The fixing roller 13 is heated with the plural fixing heaters 11 as the heating means.

The pressure roller 12 as the pressure member is urged toward and in pressurized contact with the fixing roller 13 by means of an elastic body such as, e.g., a spring, not shown. The pressure roller 12 contacts the fixing roller 13 thereby to form a nipping portion.

The thermistor 2 functions as a temperature detection member for detecting a surface temperature of the fixing roller 13. That is, the thermistor 2 is an element changing its own resistance according to the temperature, so that the temperature detection unit 100 in the printing control unit 1 detects the temperature of the thermistor 2 upon detection of its resistance. With the first embodiment, employed is an element having characteristics reducing its own resistance as the temperature increases. The thermistor 2 is arranged at a center of the fixing roller 13 in the longitudinal direction, but the location of the thermistor 2 is, as matter of course, not limited to the center.

Figure 4:
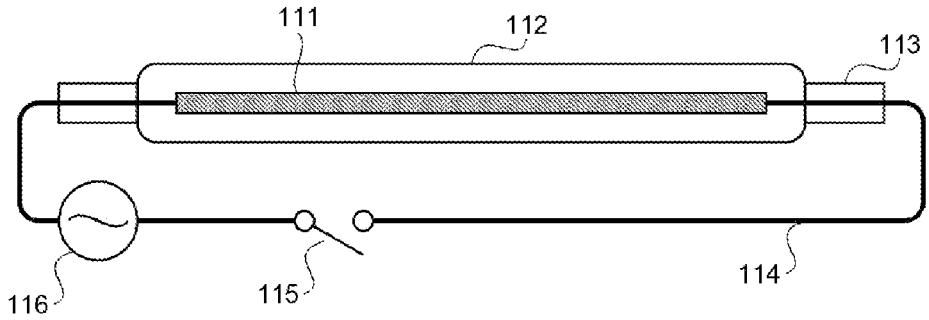
FIG. 4(*a*) is a cross section showing the fixing device cut along in a longitudinal direction, and FIG. 4(*b*) is a diagram showing a relation between a switching control signal and a heat generation amount of a fixing heater.
Figure 4:
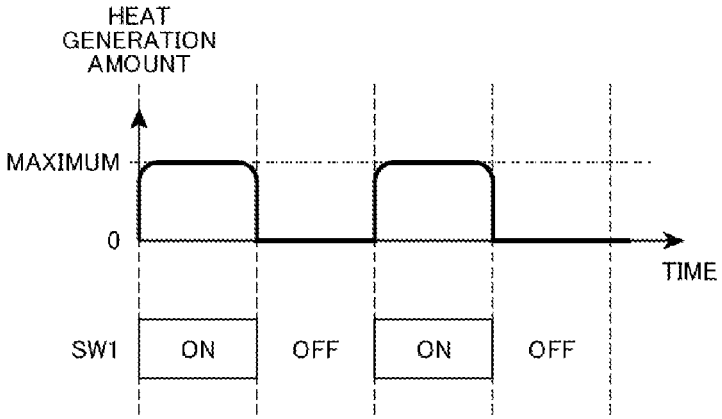

FIG. 4(*a*) shows a detailed structure of the fixing heater 11 and the heater power source 10. As shown in FIG. 4(*a*), the fixing heater 11 includes a filament 111 as a heat generator, a glass tube 112 as a holder for holding inclusion gas and the filament 111, an insulator 113, not shown, for electrically insulating a holder for the fixing heater 11 within the fixing roller, and a heater wiring 114 for supplying electric power to the filament 111 from an alternative current power source 116. The heater power source 10 has the alternative current power source 116, and a switch 115 for controlling power supply from the alternative current power source 116 to the heater 11.

More specifically, the filament 111 is contained within the glass tube 112. The insulator 113 is disposed on each end of the glass tube 112, and the filament 111 and the heater wiring 114 are connected with each other in the interior of the insulator 113. The other end of the heater wiring 114 is connected to the alternative current power source 116 and the switch 115, respectively. As the filament 111, such as, e.g., tungsten filament is used. The glass tube 112 contains an inert gas or gases such as, e.g., argon or krypton, as well as such as, e.g., bromine, or chlorine in a state of an organohalide or organohalides, thereby allowing, in a case to perform heating and cooling, to present a heating function throughout the duration of the fixing device 6 upon generation of a halogen cycle among the halogens produced therein and the tungsten. An insulator such as, e.g., ceramics is employed for the insulator 113.

With the switch 115, the conducting state of the output is controlled based on the control signal, and the control signal is outputted from the printing control unit 1, not shown. One end of the switch 115 is connected to the alternative current power source 116, while the other end is connected to one end of the heater wiring 114. A semiconductor switch capable of flowing a large current such as e.g., a triac, can be used as the switch 115. The triac is a bidirectional three terminal thyristor performing switching operation by controlling any current flowing in either forward or reverse direction in the same way with a single gate electrode.

The switch 115, with such a structure, can control the power supply to the fixing heater 11 according to the instruction provided out of the printing control unit 1, not shown, by supplying and shutting off the power supply to the fixing heater 11 in accordance with the control signal from the printing control unit 1. The power supply provided from the alternative current power source 116 is sent to the filament 111 via the wiring 114, and the filament 111 generates heat with the supplied power. The glass tube 112 is transparent, thereby permeating heat generated by the heat generation of the filament 111, and transmitting the heat to the interior surface of the core metal of the fixing roller, not shown. The voltage applied to the fixing heater 11 is, e.g., 100 V, and the output of the fixing heaters 11 is, e.g., 600 W, respectively. It is to be noted that a fixing device according to the invention may have other specifications and is not limited to the above specification, as a matter of course.

FIG. 4 (*b*) shows a relationship between the control signal of the switch 115 and the heat generation amount of the fixing heater 11. An upper portion of FIG. 4 (*b*) shows a relationship between time and the heat generation amount of the fixing heater 11, while a lower portion thereof shows an on-and-off state of the switch 115. As shown in FIG. 4 (*b*), the heater power source 10 can make only two states, supply and cut off, of the alternative current electric power from the alternative current power source 116 by means of the switch 115. Adjustment of the heating amount of the fixing roller 13 is controlled by adjustment of heating time within a prescribed period.

Figure 5:
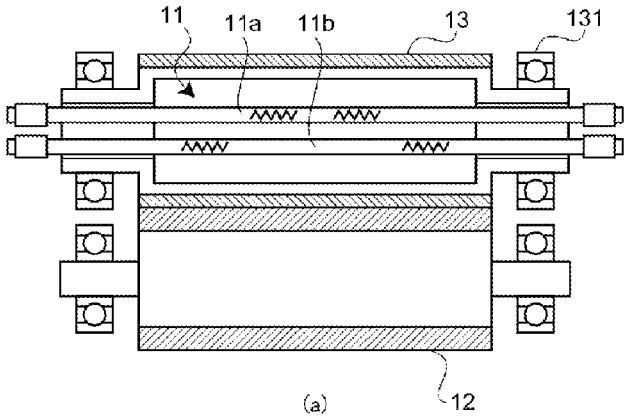
FIG. 5 (*a*) is a cross section showing the fixing device cut along in a longitudinal direction, FIG. 5(*b*) is another cross section showing the fixing device cut along in a perpendicular direction to the longitudinal direction, and FIG. 5(*c*) is a diagram showing a heat generation profile of the fixing heater.
Figure 5:
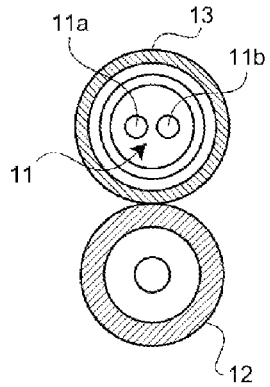
Figure 5:
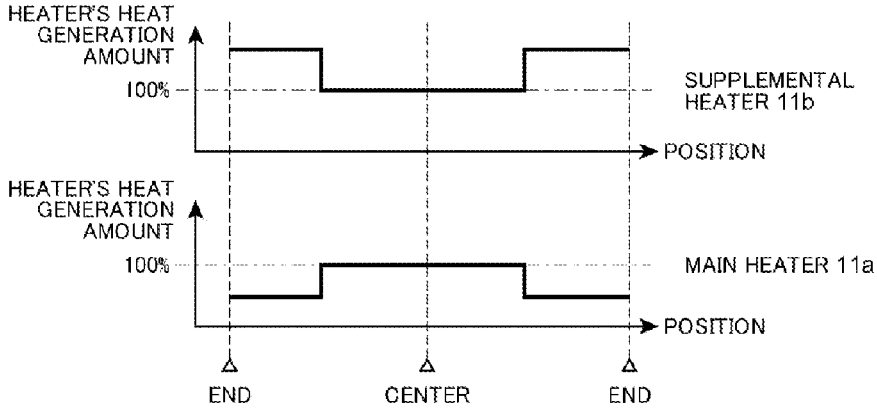

FIG. 5(*a*) shows a cross section of the fixing device 6 cut along a longitudinal direction thereof; FIG. 5(*b*) shows a cross section of the fixing device 6 cut along a direction perpendicular to the longitudinal direction thereof; FIG. 5(*c*) shows a heat generation profile of the fixing heater 11. The heat generation profile is described in detail below. An upper portion of FIG. 5(*c*) shows the heat generation profile of a supplemental heater 11*b*, and a lower portion of FIG. 5(*c*) shows the heat generation profile of a main heater 11*a*. In each drawing, the vertical axis indicates heater's heat generation amount (%), and the horizontal axis indicates location.

As shown in FIGS. 5(*a*), 5(*b*), two fixing heater 11 serving as heating means, namely, the main heater 11*a* and the supplemental heater 11*b* are arranged within the fixing roller 13. The heater having a larger heat generation amount at a center than that at an end used mainly for successive printing operation is herein defined as the main heater 11*a*, and conversely, the heater having a larger heat generation amount at an end than that at a center is defined as the supplemental heater 11*b*. As shown in FIG. 5(*c*), the heat generation profiles along the longitudinal direction of both heaters, or the main heater 11*a* and the supplemental heater 11*b*, are different between the plural fixing heaters 11*a*, 11*b*. The reason is described below.

That is, the fixing roller 13 is rotatable because of needing to feed paper, and is held to a chassis, not shown, of the fixing device 6 at each end of the fixing roller 13 with rotatable bearing members 131. A part of heat transferred to the fixing roller 13 from heat generation of the fixing heater 11 is transferred to the chassis through the bearing members 131. The chassis has to be large in size for required rigidity, and therefore, more heat amount is required to increase the chassis temperature. The heat amount is much more than that of the fixing roller 13.

According to this, particularly when the fixing roller 13 begins to be heated from a state that the entire fixing device 6 is cooled down to the room temperature, the temperature of the end of the fixing roller 13 in the longitudinal direction is not increased due to heat dissipation to the chassis even if the center of the fixing roller 13 is heated up, so that failure of fixing operation may occur.

In a successive printing situation, the paper having the same temperature as the room temperature successively goes by the fixing device 6, and takes away the heat. Because the heating control unit 102 of the printing control unit 1 tries to maintain constant the temperature of fixing roller 13, the fixing heater 11 increases its heating amount. The widths of the paper to be printed, however, are well diversified, and in a case where the apparatus makes printing on a paper having a narrower width than the heating width of the fixing heater 11, the end of the fixing roller 13 in the longitudinal direction is overly heated because the narrow paper does not take away the heat.

As printing speed increases, a paper amount going by the fixing device 6 per unit time increases, thereby increasing the heat amount taken away with the paper. The fixing heater 11 accordingly increases its heat generation amount, so that the overheated amount at the end as described above is further increased.

To recoup this, the main heater 11*a*, as one of the two fixing heaters 11, is set to have a larger heat generation amount at the center than that at the end, and the supplemental heater 11*b* as the other of the two fixing heaters 11 is set to have a larger heat generation amount at the end than that at the center. The heaters 11*a*, 11*b* are selectively driven in accordance with situations, thereby avoiding occurrences of fixing failures due to lowered temperature of the fixing roller 13 as well as avoiding damages or the like caused by the overheated ends of the fixing roller 13.

Figure 6:
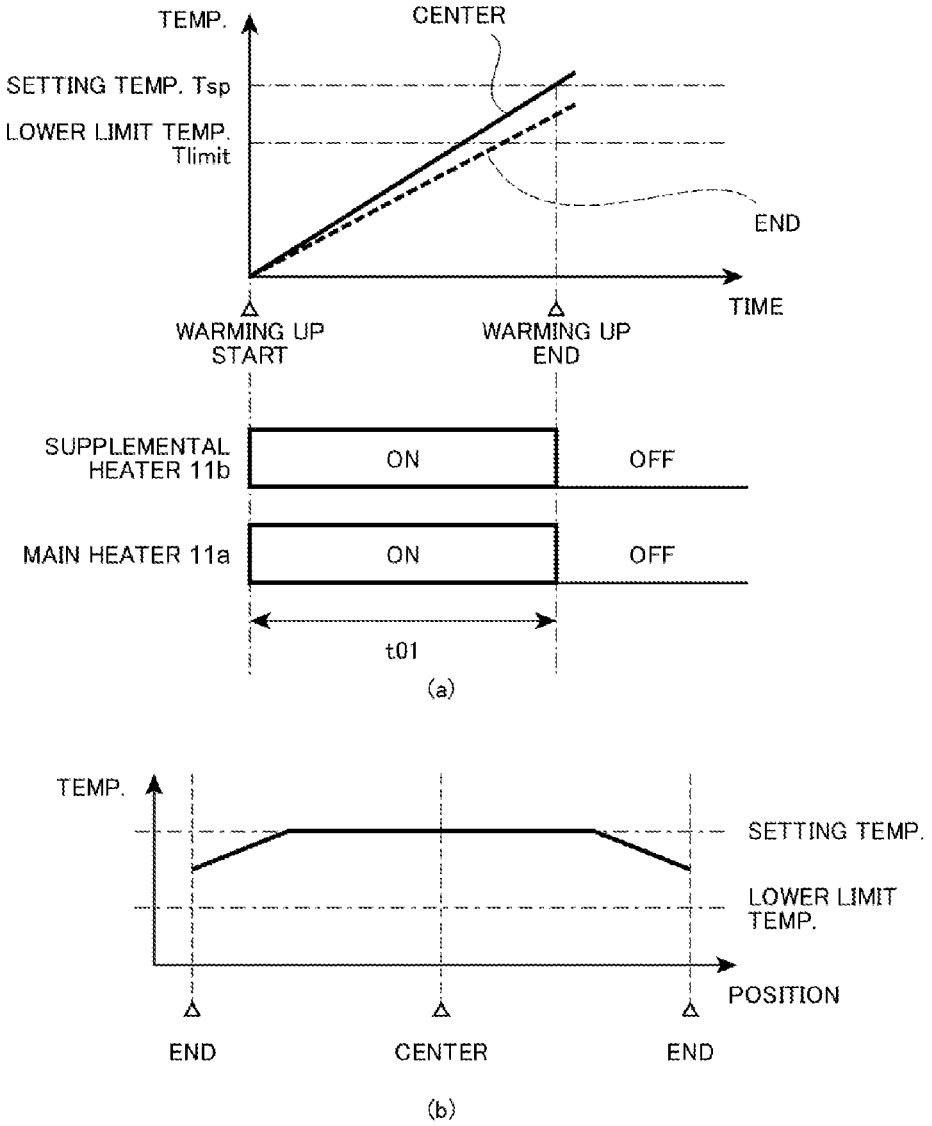
FIG. 6 (*a*) is a diagram in which an upper portion shows a time chart illustrating changes of temperature of the fixing heater where the heater is heated for warming up so as to be capable of fixing from the fixing device's cooling down to a room temperature while a lower portion shows the on and off state of the fixing heater, and FIG. 6(*b*) is a diagram showing a heat generation profile of the fixing roller along the longitudinal direction.

Next, the upper portion of FIG. 6(*a*) shows temperature changes of the fixing heater 11 where the fixing device 6 is cooled down to the room temperature and then warmed up until becoming capable of fixing, and the lower portion of FIG. 6(*b*) shows the on-and-off state of the heaters 11, namely the main heater 11*a* and the supplemental heater 11*b*. FIG. 6(*b*) shows the temperature profile of the fixing roller 13 along the longitudinal direction. Hereinafter, a general method for setting the heat generation amount in the longitudinal direction of the fixing heater 11 made of halogen heater(s) is described below.

To increase the temperature of the fixing roller 13, the printing control unit 1 provides an instruction for heating up to the heater power source 10 ("ON" in the lower portion of FIG. 6(*a*)). Both of the fixing heaters 11*a*, 11*b* are normally driven at the same time to generate the maximum heating amount to render the image forming apparatus begin image forming operation at an early timing. The power consumption at that time reaches 600×2=1200 Watt only from the fixing heaters 11*a*, 11*b*, and reaches around 1300 Watt when including other portions of image formation.

In the printing control unit 1, the temperature detection unit 100 detects with the thermistor 2 that the temperature of the fixing roller 13 reaches setting temperature Tsp, and the heating control unit 102 stops the drive of fixing heaters 11*a*, 11*b* ("OFF" in the lower portion of FIG. 6(*a*)). An illustration showing the temperature profile of the fixing roller 13 at that time is FIG. 6(*b*).

As described above, the heat generation profile of the fixing heaters 11, namely the main heater 11*a*, and the supplemental heater 11*b*, is so set that the temperature profile along the longitudinal direction of the fixing roller 13 at an ending timing of warming up operation rendering printing operable becomes higher than the lower temperature limit Tlimit at which no fixing failure occurs. With this setting, therefore, the fixing device 6 is able to prevent fixing failures from occurring without reducing any productivity.

Figure 7:
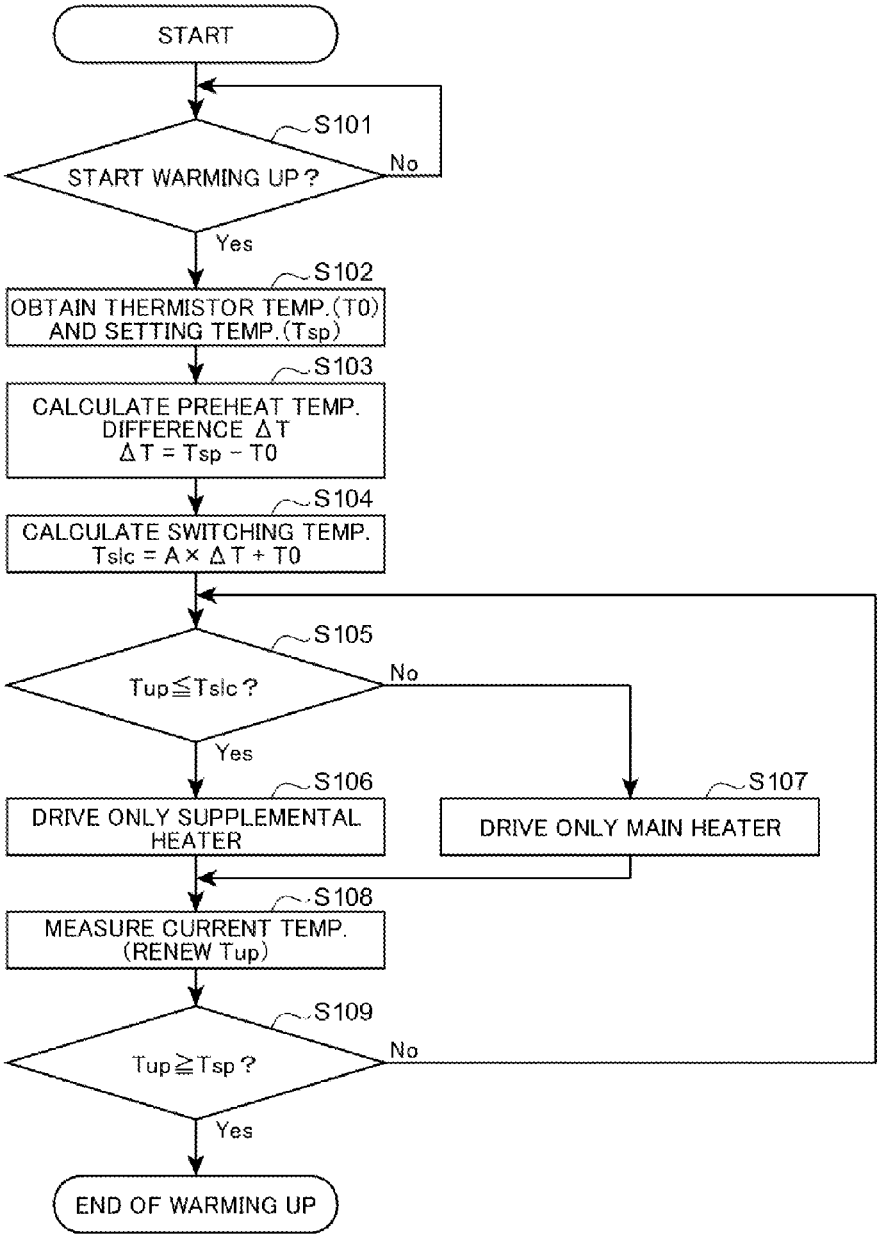
FIG. 7 is a flowchart illustrating unique operation of the fixing device according to the first embodiment of the invention.

Referring to the flowchart shown in FIG. 7, specific operations of the fixing device 6 in the image forming apparatus according to the first embodiment is described. The operations herein are described with reference to the structural diagram of FIG. 2 and the control and temperature change illustration of FIG. 8.

Figure 8:
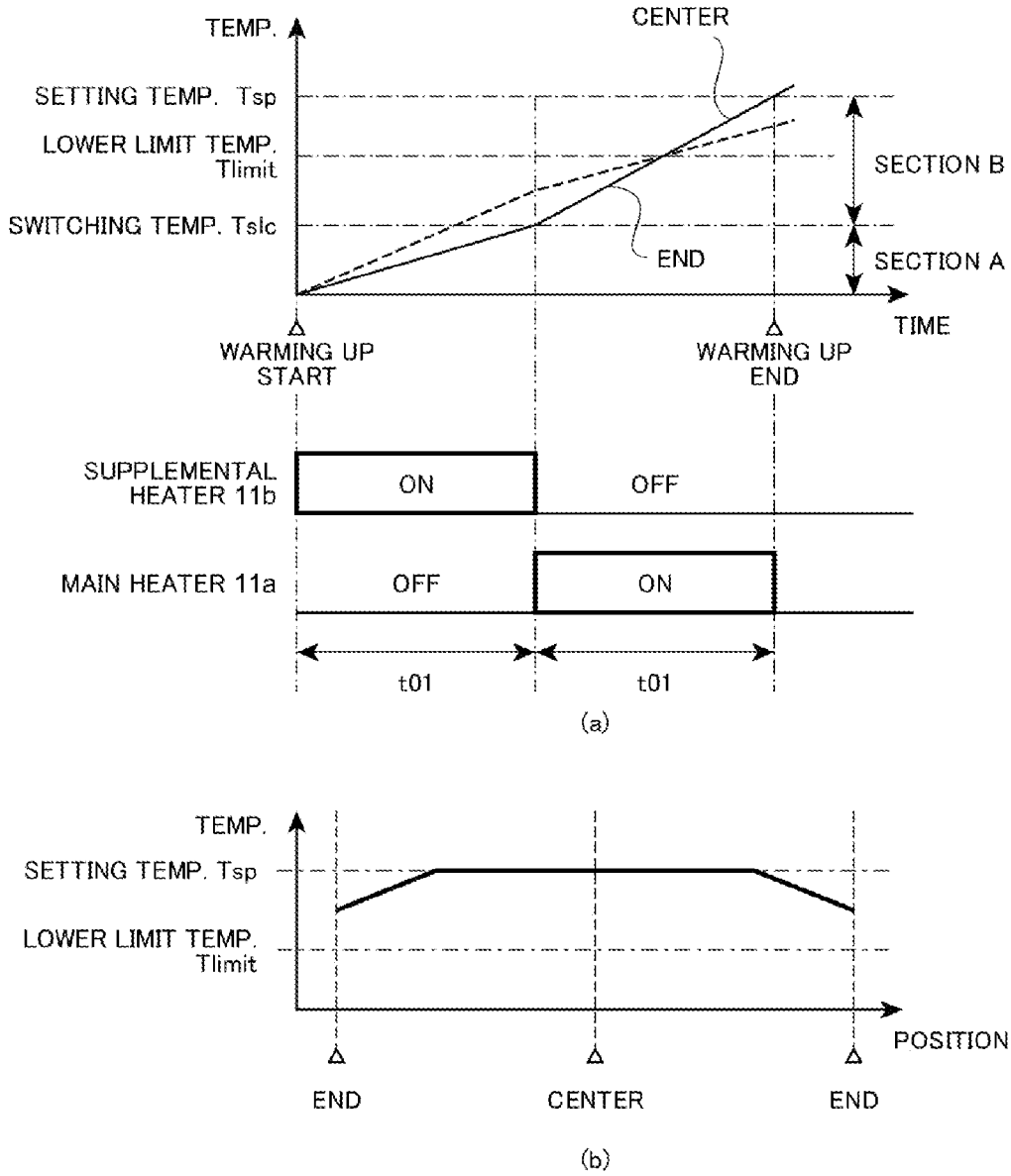
FIG. 8(*a*) is a diagram in which an upper portion shows a time chart illustrating changes of temperature of the fixing heater where the heater is heated for warming up so as to be capable of fixing from the fixing device's cooling down to a room temperature while a lower portion shows the on and off state of the fixing heater, and FIG. 8(*b*) is a diagram showing a heat generation profile of the fixing roller along the longitudinal direction.

It is to be noted that the upper portion of FIG. 8(*a*) shows temperature changes of the fixing heater 11 where the fixing device 6 is cooled down to the room temperature and then warmed up until becoming capable of fixing, and the lower portion of FIG. 8(*b*) shows the on-and-off state of the heaters 11, namely the main heater 11*a* and the supplemental heater 11*b*. FIG. 8(*b*) also shows a temperature profile of the fixing roller 13 along the longitudinal direction.

Basic operation as a premise is described before describing specific operations. When the printing control unit 1 receives a printing instruction, the unit 1 rotates the fixing roller 13 via gears, not shown, by the paper conveyance unit 4. A judgment is made as to whether the detected temperature at the thermistor 2 in the fixing device 6 is within a preset temperature range for allowing printing operation, and if it is within the range, the unit 1 begins conveyance of the paper.

The term "temperature range for allowing printing operation" is a temperature range capable of fixing toner onto paper, and includes Tlimit serving as a lower limit temperature and T2 serving as an upper limit temperature. The temperatures Tlimit, T2 are stored in the memory unit 103 in advance. The temperature Tlimit is, e.g., 160 degrees Celsius, and the temperature T2 is, e.g., 200 degrees Celsius, providing that the temperatures Tlimit, T2 are not limited to those.

If the detected temperature is higher than the upper limited temperature T2, the heating control unit 102 stops the power supply from the heater power source 10 to the fixing heater 11, thereby decreasing the temperature of the fixing roller 13, or cooling down the fixing roller 13. Conversely, if the detected temperature is lower than the lower limit temperature Tlimit, the heating control unit 102 supplies power from the heater power source 10 to the fixing heater 11, thereby increasing the temperature of the fixing roller 13, or warming up the fixing roller 13.

In specific operation, the printing control unit 1 judges as to whether the device begins warming up or not (S101) when starting operation. When warming-up starts ("Y" at S101), the temperature detection unit 100 detects the temperature of the current fixing roller 13 via the thermistor 2, and the temperature is set to the current temperature Tup. The temperature of the thermistor 2 before beginning of the heating control of the fixing heater 11 is set to T0. The preset setting temperature Tsp is obtained. The setting temperature Tsp is stored in the memory unit 103, and set to, e.g., 180 degrees Celsius (S102).

Subsequently, in the printing control unit 1, the heater selection unit 101 calculates a preheating temperature difference ΔT (ΔT=Tsp−T0) (S103), and calculates a switching temperature Tslc (Tslc=A×ΔT+T0) (S104). The coefficient A for calculating the switching temperature Tslc is sought experimentally and stored in advance in the memory unit 103, and is, e.g., 0.45.

In the printing control unit 1, then, the heater selection unit 101 compares the current temperature Tup of the fixing roller 13 with the switching temperature Tslc (S105). Where it is a case that Tup≦Tslc at S105 (i.e., section A in the upper portion of FIG. 8 (*a*)), the apparatus drives only the supplemental heater 11*b* (S106) as shown in the lower portion in FIG. 8(*a*). To the contrary, where it is a case that Tup>Tslc at S105 (i.e., section B in the upper portion of FIG. 8 (*a*)), the apparatus drives only the main heater 11*a* (S107) as shown in the lower portion in FIG. 8(*a*).

Subsequently, with the printing control unit 1, the temperature detection unit 100 detects the temperature of the thermistor 2 to detect the current temperature of the fixing roller 13, thereby renewing the current temperature Tup (S108).

In the printing control unit 1, then, the heater selection unit 101 compares the current temperature Tup with the setting temperature Tsp (S109). Where it is a case that Tup<Tsp (proceeding to "N" at S109), the warming up operation is continued upon returning to S105, because it is judged that some fixing failure may occur due to inadequate heating at the fixing roller 13. To the contrary, where it is a case that Tup≧Tsp (proceeding to "Y" at S109), the warming up operation ends because it is judged that the fixing roller 13 is adequately heated so that the temperature of the fixing roller 13 does not cause any fixing failure.

According to the above processes, in a case where the warming up beginning temperature T0 is 25 degrees Celsius and where the setting temperature is 180 degrees Celsius, the switching temperature Tslc is 0.45×(180−25)+25=95 degrees Celsius. Thus, only the supplemental heater 11*b* is driven in a case that it is 95 degrees Celsius or below, while the main heater 11*a* is driven in a case that it is higher than 95 degrees Celsius.

FIG. 8(*b*) is a diagram showing an advantage of the embodiment. Even where the fixing heaters 11, or namely the main heater 11*a* and the supplemental heater 11*b*, are driven selectively or exclusively at a time, the drive periods of the respective fixing heaters 11*a*, 11*b* become the same according to the first embodiment. The profile along the longitudinal direction of the heating amount given from the respective heaters 11*a*, 11*b* to the fixing roller 13 can be the same as that in a case where both heaters 11*a*, 11*b* are concurrently driven to increase the temperature up to the setting temperature, so that the temperature profile also can be the same as that at a time when the warming up operation is completed, and so that the apparatus can prevent any fixing failure from occurring.

As described above, according to the first embodiment, provided is a fixing device having the fixing roller 13 as a fixing member for fixing a developer to a recording medium and a plurality of fixing heaters 11 serving as heating units for heating the fixing member, the fixing device having: the temperature detection unit 100 and the thermistor 2 serving as a temperature detecting unit for detecting temperature of the fixing member; the RAM 104 serving as a first memorizing unit for memorizing a switching temperature for switching drive of the heating units; the heater selection unit 101 serving as a selecting unit for selecting the heating unit to be driven among the plural heating units based on the switching temperature and the temperature of the fixing member detected through the temperature detecting unit; and the heating control unit 102 serving as a heating control unit for selectively driving the heating unit selected by the selecting unit.

The fixing device further includes the memory unit 103 serving as the second memory means for memorizing a setting temperature as a target of the fixing member, and the selection means calculates the temperature difference between the setting temperature and the preheating temperature of the fixing member from the temperature detection unit 100 and the thermistor 2 serving as the temperature detection means, thereby featuring calculation of the switching temperature based on the temperature difference. This fixing device therefore can simplify the fixing control when suppressing the maximum power consumption.

The heating control means can operate to selectively drive the heating means until the temperature of the fixing member reaches the setting temperature.

The plural heating means are formed of the main heater 11*a* having a setting that the heat generation amount of a center portion is larger than the heat generation amount of an end portion, and the supplemental heater 11*b* having a setting that the heat generation amount of an end portion is larger than the heat generation amount of a center portion. The heater selection unit 101 as a selection means may select only the supplemental heater 11*b* in a case that the temperature of the fixing roller 13 serving as the fixing member detected via the temperature detection unit 100 and the thermistor 2 serving as the temperature detection means is equal to or lower than the switching temperature while selecting only the main heater 11*a* in a case that the temperature of the fixing member detected via the temperature detection means is higher than the switching temperature.

The fixing device therefore can suppress the temperature of the fixing roller along the longitudinal direction at the ending time of the warming up operation within the temperature range suitable for fixing operation. The fixing device therefore can prevent printing failure from occurring even where reducing the maximum power consumption without increasing the number of thermistors.

In a case where the main heater and the supplemental heater have the different outputs from each other (e.g., 800 W/400 W), the fixing device can obtain the same advantages with the same control by experimentally seeking the coefficient A for calculating the switching temperature.

With a prior art, the temperature detection means have to be placed at plural locations in the longitudinal direction, so that it raises a problem that the number of parts increases. To the contrary, with this embodiment, even where the plural heaters are selectively driven to reduce the maximum power consumption, the fixing device can prevent, with a sole thermistor, printing failure from occurring, thereby possibly reducing the number of parts.

With this embodiment, one time of switching of the fixing heaters 11 serving as the heating means during the warming up operation is enough, and can prevent flickers from occurring at peripherals.

Second Embodiment

Figure 9:
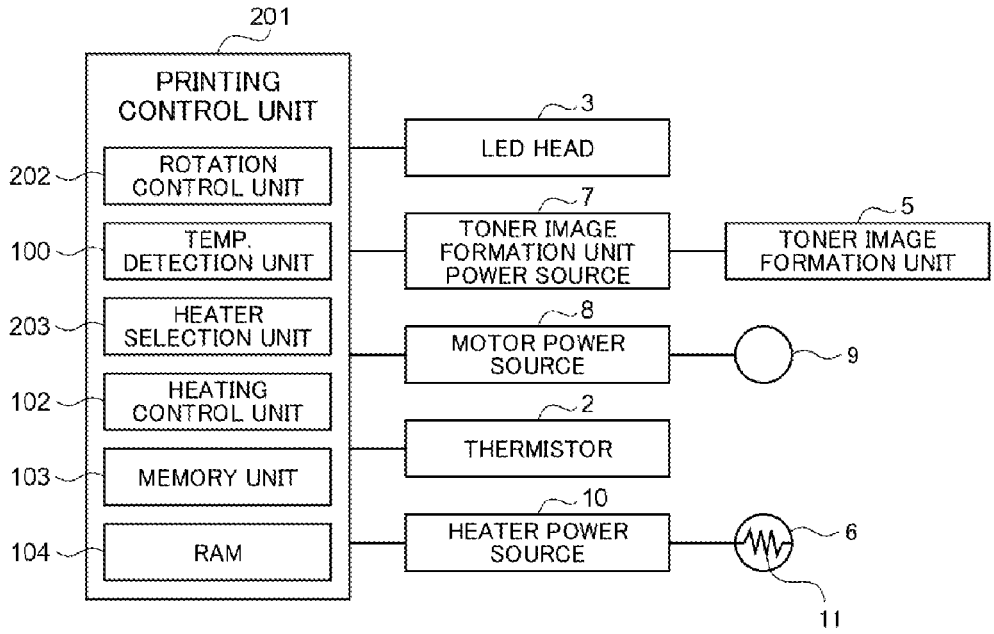
FIG. 9 is a block diagram showing a control system of the image forming apparatus adapting the fixing device according to a second embodiment of the invention.

FIG. 9 shows a control block diagram of an image forming apparatus adapting a fixing device according to the second embodiment of the invention. It is to be noted that a duplicated description is omitted upon using the same reference numbers given to the same structural members as those in the first embodiment (FIG. 2). With the image forming apparatus according to this embodiment, a printing control unit 201 has a rotation control unit 202, and a heater selection unit 203 is different from the heater selection unit 101 in the first embodiment, but other structures are the same as those in the first embodiment. The structure of the fixing device 6 is the same as those in FIG. 3, and it is described properly with the reference numbers shown in FIG. 3.

For example, toner may remain within the fixing device 6, where image formation operation is stopped upon detecting any occurrence of abnormal situation in paper feeding during printing operation. In a case that the device 6 remains as it is for a long time of period, the temperature of the fixing roller 13 decreases to the room temperature, because the fixing heaters 11 are prohibited from heating under such a circumstance to secure the safeness. When the fixing roller 13 is rotated under such a circumstance, the toner firmly adhering to the surface of the fixing roller 13 may cause the fixing roller 13 broken down in accordance with the surface rigidity of the fixing roller 13 because the toner is solid in a situation at a low temperature or normal temperature. In consideration with such a problem, there is an image forming apparatus rotating the fixing roller upon melting the toner by increasing the surface temperature of the fixing roller 13 to a prescribed temperature.

Figure 10:
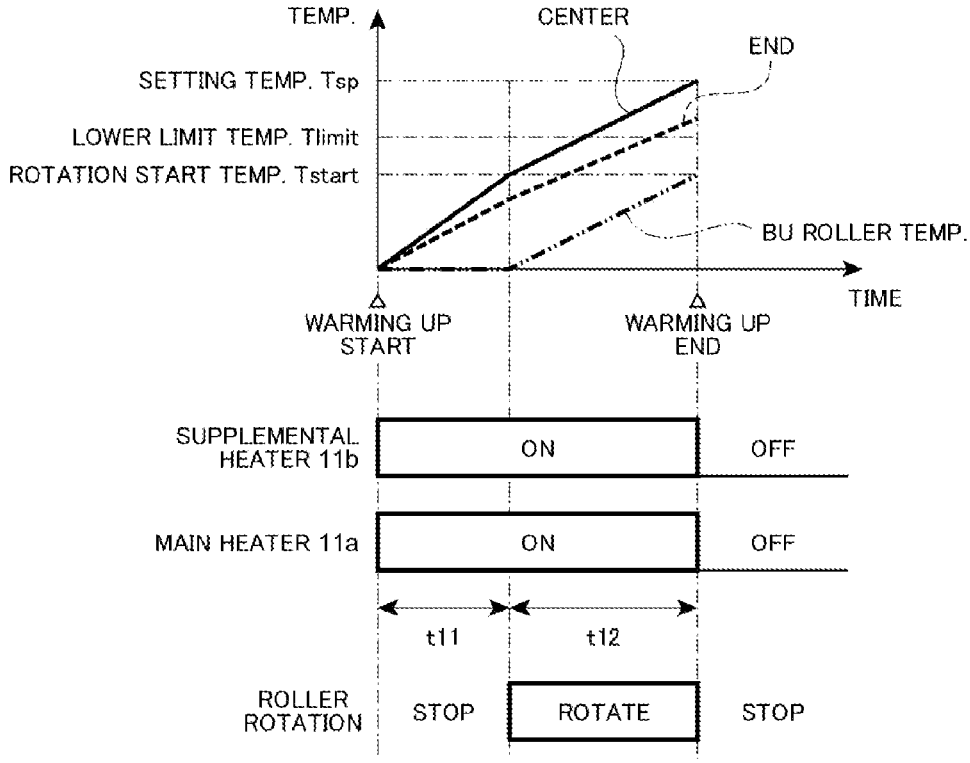
FIG. 10 is a diagram showing temperature changes and rotation state of the fixing roller.

FIG. 10 shows temperature changes of the fixing roller 13 in such an image forming apparatus and its rotation state, and the basic operation thereof is described. The structures in FIGS. 3, 9, herein, are also referred properly.

As shown in FIG. 10, where the surface temperature of the fixing roller 13 is lower than the rotation starting temperature Tstart (i.e., temperature at which toner melts sufficiently), the fixing roller 13 is set to be a stop state. Where the surface temperature becomes equal to or higher than the rotation starting temperature Tstart, the rotation control unit 202 instructs the motor power source 8 to rotate the paper conveyance motor 9 and to rotate the fixing roller 13. When the temperature of the fixing roller 13, under this circumstance, becomes equal to or higher than the setting temperature Tsp, this warming-up operation ends, and the unit 202 stops drive of the heaters and rotation of the fixing roller 13.

When the fixing roller 13 rotates, the pressure roller 12 also rotates because the fixing roller 13 is in pressurized contact with the pressure roller 12. Because the pressure roller 12 does not have any heat source, such as a heater, inside, the temperature of the pressure roller 12 at a time beginning rotation is little increased and remains at a substantially low temperature state. Where the fixing roller 13 is rotated under this circumstance, the pressure roller 12 is driven to rotate, and the entire surface of the pressure roller 12 is warmed up as its rotation continues because the position of the pressure roller 12 contacting to the fixing roller 13 at the nipping portion moves according to the rotation. That is, the heat amount generated at the fixing heater 11 is transferred to the fixing roller 13, and further transferred to the pressure roller 12 as further rotated.

In this situation, the heat generation amounts of the heaters 11*a*, 11*b* are the maximum because the main heater 11*a* and the supplemental heater 11*b* are always in a heat generating state as shown in FIG. 10 regardless the rotation state of the fixing roller 13. Where the fixing roller 13 is therefore rotated, the rate of temperature increase at the fixing roller 13 become lower because the heat is transferred or dissipated to the pressure roller 12 as described above.

To overcome this problem, the fixing device according to the second embodiment and the image forming apparatus employing the device are made with further improvements, and the image forming apparatus thus having the feature in which the rate of the temperature increase at the fixing roller 13 may vary according to the rotation or stop state of the fixing roller 13 as described above, has advantages that the maximum power consumption is reduced by changing the heater switching method according to rotation or stop of the roller and that the temperature along the longitudinal direction is suppressed within a prescribed range.

Figure 11:
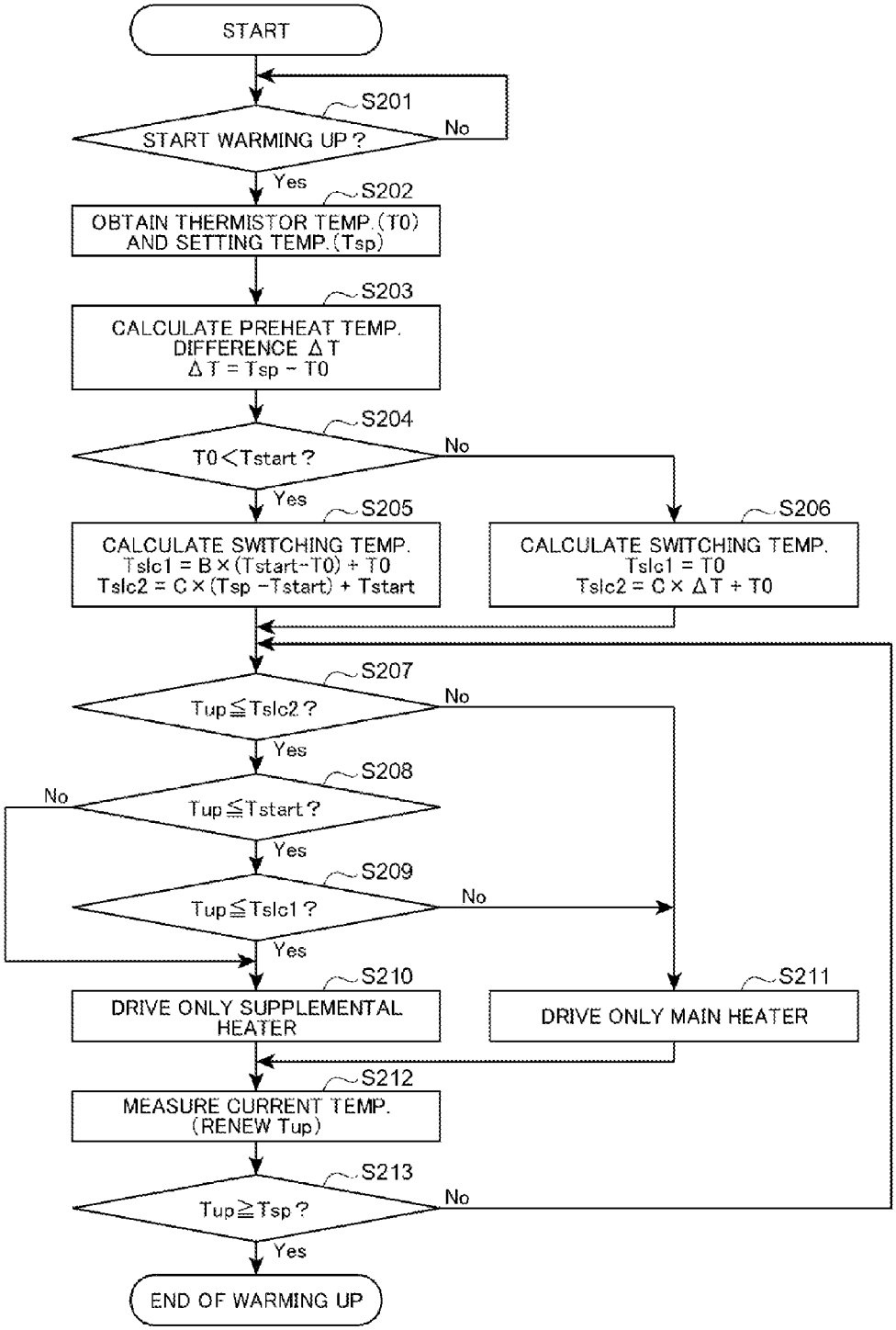
FIG. 11 is a flowchart illustrating unique operation of the fixing device according to the second embodiment of the invention.

Referring to the flowchart in FIG. 11, characteristic operation of the image forming apparatus according to the second embodiment is described.

When the operation starts, the printing control unit 201 judges as to whether to start the warming-up operation (S201), and if the warming up is started (proceeding to "Y" at S201), the temperature detection unit 100 detects the current temperature of the fixing roller 13 from the thermistor 2 and renders the detected temperature set as the current temperature Tup. The temperature of the thermistor 2 prior to the beginning of the heat control at the fixing heaters 11 is set as T0. The preset setting temperature Tsp is obtained. The setting temperature Tsp is stored in advance in the memory unit 103 and can be, e.g., 180 degrees Celsius (S202). The printing control unit 201 subsequently calculates a preheating temperature difference ΔT (ΔT=Tsp−T0) at the heater selection unit 203 (S203).

After the preheating temperature difference ΔT is thus calculated at the heater selection unit 203, the printing control unit 201 obtains a preset rotation starting temperature Tstart, and compares the temperature Tstart with the temperature T0 (S204). The rotation starting temperature Tstart is stored in advance in the memory unit 103.

At step S204, if T0<Tstart is satisfied, the heater selection unit 203 calculates the switching temperature according to the following formula (S205).

$$Tslc1=B\times(T\text{start}-T0)+T0$$

$$Tslc2=C\times(Tsp-T\text{start})+T\text{start}$$

To the contrary, if T0≧Tstart is satisfied, the heater selection unit 203 calculates the switching temperature according to the following formula (S206).

$$Tslc1=T0$$

$$Tslc2=C\times\Delta T+T0$$

The coefficients B, C are values stored in advance in the memory unit 103 and sought experimentally, and the coefficients B, C satisfy that, e.g., B=0.4 and C=0.3.

Subsequently, with the printing control unit 201, the heater selection unit 203 compares the current temperature Tup with the switching temperature Tslc2 (S207), and if Tup>Tslc2 is satisfied, the heating control unit 102 drives only the main heater 11*a* (i.e., section B2 in FIG. 12(*a*)) (S211). On the other hand, if Tup≦Tslc2 as well as Tup>Tstart are satisfied, the printing control unit 201 renders the heater control unit 102 drive only the supplemental heater 11*b* (i.e., section A2 in FIG. 12(*a*)) (S210). If Tup≦Tslc2 as well as Tup≦Tstart are satisfied while Tup≦Tslc1 is satisfied, the heating control unit 102 drives only the supplemental heater 11*b* (i.e., section A1 in FIG. 12(*a*)) (S210). If Tup>Tslc1 is satisfied at S209, the heating control unit 102 drives only the main heater 11*a* (i.e., section B1 in FIG. 12(*a*)) (S211).

The judgment processing from S207 to S209 above are summarized as shown in Tables below.

TABLE 1

Figure 12A:
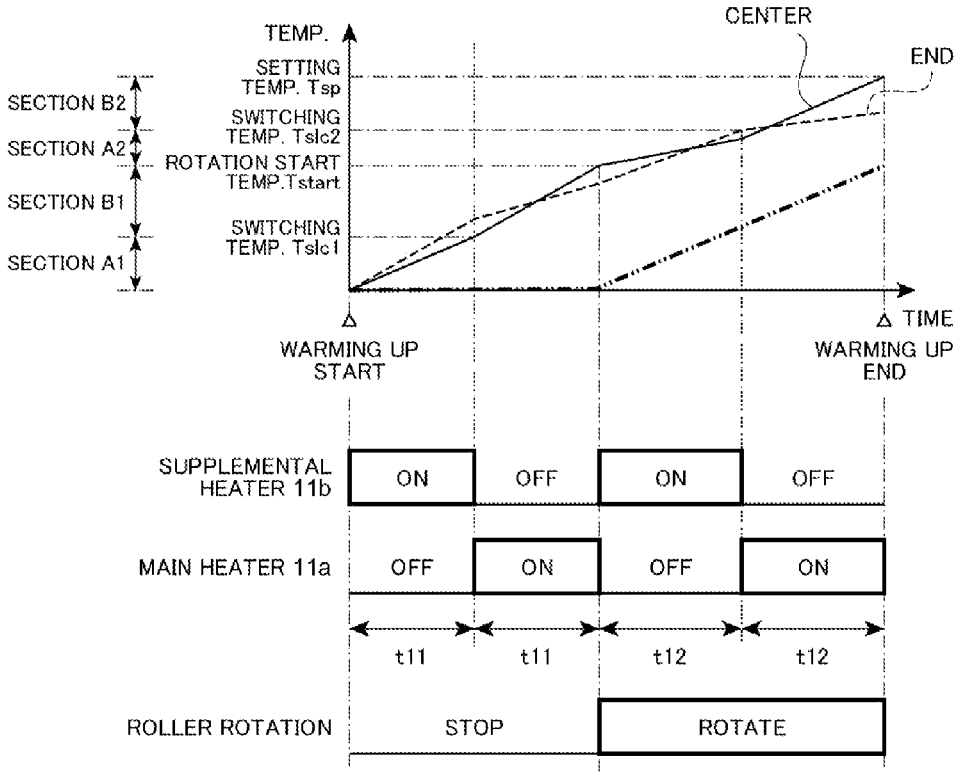
FIG. 12(*a*) is a diagram in which an upper portion shows a time chart illustrating changes of temperature of the fixing heater where the heater is heated for warming up so as to be capable of fixing from the fixing device's cooling down to a room temperature while a lower portion shows the on and off state of the fixing heater.
Figure 12B:
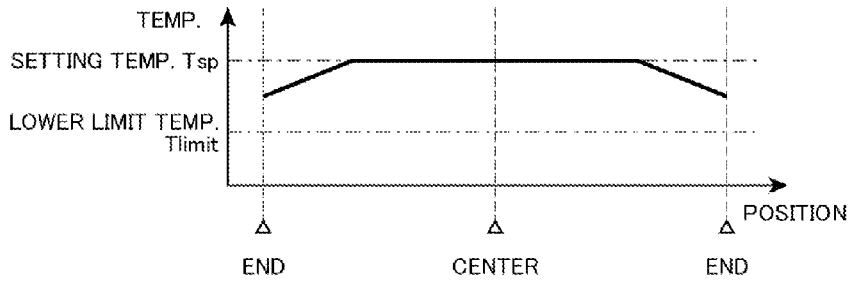

| Where T0 < Tstart (T0 < Tslc1 < Tstart < Tslc2), | | |
|---|---|---|
| Tup | Driven Heater(s) | Section corresponding in FIG. 12 |
| T0 to Tslc1 | Supplemental Heater | A1 |
| Tslc1 to Tstart | Main Heater | B1 |
| Tstart to Tslc2 | Supplemental Heater | A2 |
| Tslc2 to Tsp | Main Heater | B2 |

TABLE 2

| Where T0 ≧ Tstart (Tslc1 < Tstart < T0 < Tslc2), | | |
|---|---|---|
| Tup | Driven Heater(s) | Section corresponding in FIG. 12 |
| T0 to Tslc2 | Supplemental Heater | A2 |
| Tslc2 to Tsp | Main Heater | B2 |

Subsequently, the printing control unit 201 detects the temperature of the thermistor 2, thereby detecting the current temperature of the fixing roller 13, and renewing the current temperature Tup (S212).

In the printing control unit 201, then, the heater selection unit 203 compares the current temperature Tup with the setting temperature Tsp (S213), and if Tup<Tsp is satisfied (proceeding to "N" at S213), the program returns to S207 for continuing the warming-up operation because it can be judged as that some fixing failure may occur due to that the fixing roller 13 is not yet adequately heated. On the other hand, if Tup≧Tsp is satisfied (proceeding to "Y" at S213), the warming-up operation ends because the fixing roller 13 is adequately heated up to a temperature not causing any fixing failure.

FIGS. 12(*a*), 12(*b*) also indicate advantages of this embodiment, and describe the situation of T0<Tstart.

For example, where T0=25 degrees Celsius, Tstart=100 degrees Celsius, and Tsp=180 degrees Celsius, it is obtained that:

$$Tslc1=0.4\times(100-25)+25=55 \text{ degrees Celsius}$$

$$Tslc2=0.3\times(180-100)+100=124 \text{ degrees Celsius}$$

That is, the supplemental heater 11*b* is driven (corresponding to Section A1 in the upper portion of FIG. 12(*a*)) where the temperature is 25 to 55 degrees Celsius, and the main heater 11*a* is driven (corresponding to Section B1 in FIG. 12(*a*)) where the temperature is 56 to 100 degrees Celsius. The supplemental heater 11*b* is driven (corresponding to Section A2 in the upper portion of FIG. 12(*a*)) where the temperature is 101 to 124 degrees Celsius, and the main heater 11*a* is driven (corresponding to Section B2 in the upper portion of FIG. 12(*a*)) where the temperature is 125 to 180 degrees Celsius.

According to the second embodiment, as shown in the lower portion of FIG. 12(*a*), the times for driving the respective heaters 11*a*, 11*b* become the same to each other (i.e., t11, t12 in FIG. 12(*a*)), even where the fixing heaters 11*a*, 11*b* are driven selectively or exclusively at a time. As shown in 12(*b*), the heat amount profile in which the respective heaters 11*a*, 11*b* provide to the fixing roller 13 along the longitudinal direction can be the same as that in a case where both of the heaters 11*a*, 11*b* are driven simultaneously to increase the temperature up to the setting temperature, so that any fixing failure can be avoided.

By operation thus described, the second embodiment of the invention further includes the rotation control unit 202 serving as the rotation control means for controlling rotational drive of the fixing roller 13 serving as the fixing member. With the second embodiment, the fixing device is provided in which the heater selection unit 203 serving as selecting means calculates plural switching temperatures according to the control state performed by the rotation control means.

The plural heating means are constituted of the main heater 11*a* having a larger heat generation amount at the center than that at the end, and the supplemental heater 11*b* having a larger heat generation amount at the end than that at the center. The plural switching temperatures are made of the first switching temperature Tslc1 and the second switching temperature Tslc2. Where the rotation control unit 202 serving as the rotation control means controls the fixing roller 13 serving as the fixing means to stop its rotation, the heater selection unit 203 selects only the supplemental heater 11*b* in a case where the temperature of the fixing member detected by the temperature detection unit 100 and the thermistor 2 serving as the temperature detection means is equal to or lower than the first switching temperature Tslc1 and selects only the main heater 11*a* in a case where the detected temperature is higher than the first switching temperature Tslc1. To the contrary, where the rotation control unit 202 serving as the rotation control means controls the fixing roller 13 serving as the fixing means to rotate, the heater selection unit 203 selects only the supplemental heater 11*b* in a case where the temperature of the fixing member detected by the temperature detection unit 100 and the thermistor 2 serving as the temperature detection means is equal to or lower than the second switching temperature Tslc2 and selects only the main heater 11*a* in a case where the detected temperature is higher than the second switching temperature Tslc2.

In a prior art, there arises a problem of the increased number of parts to provide the temperature detecting means necessarily at plural positions in the longitudinal direction to suppress the maximum power consumption. To the contrary, according to the second embodiment, the image forming apparatus in which the rotation state of the fixing roller 13 changes according to the temperature of the fixing roller 13 can reduce its part number because the apparatus can prevent and printing failure from occurring only with the thermistor 2 arranged at the center even where the plural fixing heaters 11 are selectively driven to suppress the maximum power consumption.

With the second embodiment, any flicker can be prevented because the switching operation of the fixing heaters 11 as the heating means during the warming-up operation can be done no more than once in a rotation state and once in a stop state of the fixing roller 13.

Although in the embodiments above the printers are used, the fixing device is applicable to such as, e.g., an MFP (Multifunction Peripheral), a facsimile machine, and a photocopier.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention should not be limited by the specification, but be defined by the claims set forth below.

What is claimed is:

1. A fixing device having a fixing member for fixing a developer to a recording medium and a plurality of heating units for heating the fixing member, said fixing device comprising:

a temperature detecting unit for detecting a temperature of the fixing member;

a first memorizing unit for memorizing a switching temperature for switching a drive of the heating units;

a selecting unit for selecting a heating unit among the plural heating units to be driven based on the switching temperature and the temperature of the fixing member detected by the temperature detecting unit; and a heating control unit for selectively driving the heating unit selected by the selecting unit, wherein the plurality of heating units are made of a main heater having a prescribed heat amount and a supplemental heater having a heat amount which is less than the heat amount of the main heater, and wherein the selecting unit selects only the supplemental heater where the temperature of the fixing member detected by the temperature detection unit is equal to or less than the switching temperature, and selects only the main heater where the temperature of the fixing member detected by the temperature detection unit is greater than the switching temperature.

2. The fixing device according to claim 1, further comprising:

a second memorizing unit for memorizing a setting temperature as a target for the fixing member, wherein the selecting unit calculates a temperature difference between the setting temperature and a temperature of the fixing member detected before heating through by the temperature detecting unit, and calculates the switching temperature based on the temperature difference.

3. The fixing device according to claim 2, wherein the heating control unit selectively drives the heating unit until that the temperature of the fixing member reaches the setting temperature.

4. A fixing device having a fixing member for fixing a developer to a recording medium and a plurality of heating units for heating the fixing member, said fixing device comprising a temperature detecting unit for detecting a temperature of the fixing member a first memorizing unit for memorizing a switching temperature for switching a drive of the heating units;

a second memorizing unit for memorizing a setting temperature as a target for the fixing member;

a selecting unit for selecting a heating unit among the plural heating units to be driven based on the switching temperature and the temperature of the fixing member detected by the temperature detecting unit, the selecting unit calculating a temperature difference between the setting temperature and a temperature of the fixing member detected before heating by the temperature detecting unit, and calculating the switching temperature based on the temperature difference; and a heating control unit for selectively driving the heating unit selected by the selecting unit, wherein the plural heating units are made of a main heater having a setting to generate heat more on a center portion than on an end portion, and a supplemental heater having a setting to generate heat more on an end portion than on a center portion, and wherein the selecting unit selects only the supplemental heater where the temperature of the fixing member detected by the temperature detection unit is equal to or less than the switching temperature and selects only the main heater where the temperature of the fixing member detected by the temperature detection unit is greater than the switching temperature.

5. The fixing device according to claim 1, further comprising:

a rotation control unit for controlling rotary drive of the fixing member, wherein the selecting unit calculates the plural switching temperature in association with control status of the rotation control unit.

6. A fixing device having a fixing member for fixing a developer to a recording medium and a plurality of heating units for heating the fixing member, said fixing device comprising:

a temperature detecting unit for detecting a temperature of the fixing member;

a first memorizing unit for memorizing a switching temperature for switching a drive of the heating units, the switching temperature is made of a first switching temperature and a second switching temperature;

a selecting unit for selecting a heating unit among the plural heating units to be driven based on the switching temperature and the temperature of the fixing member detected by the temperature detecting unit; and a heating control unit for selectively driving the heating unit selected by the selecting unit;

rotation control unit for controlling rotary drive of the fixing member, wherein the selecting unit calculates the plural switching temperature in association with control status of the rotation control unit, wherein the plural heating units are made of a main heater having a setting to generate heat more on a center portion than on an end portion, and a supplemental heater having a setting to generate heat more on an end portion than on a center portion, and wherein, in a case that the rotation control unit controls the fixing member to stop rotating, the selecting unit selects only the supplemental heater where the temperature of the fixing member detected through the temperature detection unit is equal to or less than the first switching temperature and selects only the main heater where the temperature of the fixing member detected through the temperature detection unit is greater than the first switching temperature, while, in a case that the rotation control unit controls the fixing member to rotate, the selecting unit selects only the supplemental heater where the temperature of the fixing member detected through the temperature detection unit is equal to or less than the second switching temperature and selects only the main heater where the temperature of the fixing member detected through the temperature detection unit is greater than the second switching temperature.

7. The fixing device according to claim 1, wherein heating profiles of the heating units in a longitudinal direction of the fixing member are different from each other.

8. The fixing device according to claim 1, wherein the number of the temperature detecting unit is one.

9. The fixing device according to claim 1, wherein the fixing member is in a form of a roller.

10. The fixing device according to claim 1, wherein the heating unit is a halogen heater.

11. The fixing device according to claim 1, wherein the temperature detection unit includes a thermistor provided at a center of the fixing member in the longitudinal direction to detect the temperature of the fixing member.

12. The fixing device according to claim 1, wherein two of the heating units are provided, and wherein the heating control unit drive exclusively one of the heating units at a time.

13. An image forming apparatus having the fixing device according to claim 1, comprising:

a toner image forming unit for forming a developer image on a recording medium.

14. The image forming apparatus according to claim 13, wherein the fixing device includes a second memorizing unit for memorizing a setting temperature as a target for the fixing member, and wherein the selecting unit calculates a temperature difference between the setting temperature and a temperature of the fixing member detected before heating by the temperature detecting unit, and calculates the switching temperature based on the temperature difference.

15. An image forming apparatus having the fixing device according to claim 4 further comprising:

a toner image forming unit for forming a developer image on a recording medium.

16. An image forming apparatus having the fixing device according claim 6 further comprising:

a toner image forming unit for forming a developer image on a recording medium.

17. The fixing device according to claim 1 further comprising:

a rotation control unit for controlling a rotary drive of the fixing member, wherein the selecting unit calculates the plural switching temperature in association with control status of the rotation control unit, wherein the plural heating units are made of a main heater having a setting to generate heat more on a center portion than on an end portion, and a supplemental heater having a setting to generate heat more on an end portion than on a center portion, wherein the switching temperature is made of a first switching temperature and a second switching temperature, and wherein, in a case that the rotation control unit controls the fixing member to stop rotating, the selecting unit selects only the supplemental heater where the temperature of the fixing member detected by the temperature detection unit is equal to or less than the first switching temperature and selects only the main heater where the temperature of the fixing member detected by the temperature detection unit is greater than the first switching temperature, while, in a case that the rotation control unit controls the fixing member to rotate, the selecting unit selects only the supplemental heater where the temperature of the fixing member detected by the temperature detection unit is equal to or less than the second switching temperature and selects only the main heater where the temperature of the fixing member detected by the temperature detection unit is greater than the second switching temperature.

* * * * *